US006109219A

United States Patent [19]

Sano

[11] Patent Number: 6,109,219

[45] Date of Patent: Aug. 29, 2000

[54] COOLING CONTROL APPARATUS AND COOLING CONTROL METHOD FOR INTERNAL COMBUSTION ENGINES

[75] Inventor: Mitsuhiro Sano, Hannou, Japan

[73] Assignee: Nippon Thermostat Co., Ltd., Kiyose, Japan

[21] Appl. No.: 09/180,113

[22] PCT Filed: May 27, 1998

[86] PCT No.: PCT/JP98/02336

§ 371 Date: Feb. 16, 1999

§ 102(e) Date: Feb. 16, 1999

[87] PCT Pub. No.: WO98/54447

PCT Pub. Date: Dec. 3, 1998

[30] Foreign Application Priority Data

May 29, 1997 [JP] Japan ..... 9-155722

[51] Int. Cl.[7] ..... F01P 7/14

[52] U.S. Cl. ..... 123/41.1; 123/41.08; 123/41.11; 123/41.12

[58] Field of Search ..... 123/41.01, 41.02, 123/41.05, 41.08, 41.1, 41.11, 41.12, 41.49

[56] References Cited

U.S. PATENT DOCUMENTS

| | | | |
|---|---|---|---|
| 4,369,738 | 1/1983 | Hirayama | 123/41.1 |
| 4,381,736 | 5/1983 | Hirayama | 123/41.1 |
| 4,475,485 | 10/1984 | Sakakibara et al. | 123/41.05 |
| 4,539,942 | 9/1985 | Kobayashi et al. | 123/41.1 |
| 4,726,324 | 2/1988 | Itakura | 123/41.1 |
| 4,726,325 | 2/1988 | Itakura | 123/41.1 |
| 4,759,316 | 7/1988 | Itakura | 123/41.08 |
| 4,798,177 | 1/1989 | Oomura et al. | 123/41.12 |
| 4,964,371 | 10/1990 | Maeda et al. | 123/41.1 |
| 4,977,862 | 12/1990 | Aihara et al. | 123/41.12 |
| 5,036,803 | 8/1991 | Nolting et al. | 123/41.1 |
| 5,111,775 | 5/1992 | Sumida et al. | 123/41.1 |
| 5,390,632 | 2/1995 | Ikebe et al. | 123/41.02 |
| 5,427,062 | 6/1995 | Chamot et al. | 123/41.1 |
| 5,482,010 | 1/1996 | Lemberger et al. | 123/41.1 |
| 5,582,138 | 12/1996 | Ziolek et al. | 123/41.1 |
| 5,609,125 | 3/1997 | Ninomiya | 123/41.12 |
| 5,979,373 | 11/1999 | Sano | 123/41.1 |

FOREIGN PATENT DOCUMENTS

| | | |
|---|---|---|
| 58-106124 | 6/1983 | Japan . |
| 62-237025 | 10/1987 | Japan . |
| 41 09 498 | 9/1992 | Japan . |
| 4-339127 | 11/1992 | Japan . |
| 7-279666 | 10/1995 | Japan . |

OTHER PUBLICATIONS

Sweden—Abstract of 9200873–9. See PCT Search Rpt.

*Primary Examiner*—Tony M. Argenbright
*Assistant Examiner*—Hai Huynh
*Attorney, Agent, or Firm*—Armstrong, Westerman, Hattori, McLeland & Naughton

[57] ABSTRACT

In an engine control unit, information showing the operation of the non-operation of the cooling fan, information showing the temperature of the coolant flowing out of the engine (1) or other parameters showing the engine operation are supplied. In the engine control unit, the temperature drop of the coolant brought about by the radiator on the basis of the operation of particularly the cooling fan is programmed to be read out from a map construction in the form of a table such that the temperature control is performed by predicting the change of the coolant. Therefore, it is possible to operate the engine at a high temperature not reaching a state of overheating such that fuel economy is attained while minimizing the generation of a poisonous exhaust gas.

10 Claims, 10 Drawing Sheets

| Th – Outdoor Air Temperature / Vehicle Speed | 60℃ | 50℃ | 40℃ | 30℃ |
|---|---|---|---|---|
| 0Km | Td11 | Td12 | Td13 | Td14 |
| 20Km | Td21 | Td22 | Td23 | Td24 |
| 40Km | Td31 | Td32 | Td33 | Td34 |
| 60Km | Td41 | Td42 | Td43 | Td44 |
| 80Km | Td51 | Td52 | Td53 | Td54 |
| 100Km | Td61 | Td62 | Td63 | Td64 |
| 120Km | Td71 | Td72 | Td73 | Td74 |
| 140Km | Td81 | Td82 | Td83 | Td84 |
| 160Km | Td91 | Td92 | Td93 | Td94 |

| Flow Ratio | 0 | 0.2 | 0.3 | 0.4 | 0.5 | 0.6 | 0.8 |
|---|---|---|---|---|---|---|---|
| Basic Valve Opening Degree $D_0$ | D01 | D02 | D03 | D04 | D05 | D06 | D07 |

Fig. 10

| Engine Revolutions / Valve Opening Angle | 500 | 1000 | 1500 | 2000 | | 5500 | 6000 |
|---|---|---|---|---|---|---|---|
| 0Degree | L 11 | L 12 | L 13 | L 14 | | L 1m | L 1n |
| 10Degree | L 21 | L 22 | L 23 | L 24 | | L 2m | L 2n |
| 20Degree | L 31 | L 32 | L 33 | L 34 | | L 3m | L 3n |
| 30Degree | L 41 | L 42 | L 43 | L 44 | | L 4m | L 4n |
| 40Degree | L 51 | L 52 | L 53 | L 54 | | L 5m | L 5n |
| 50Degree | L 61 | L 62 | L 63 | L 64 | | L 6m | L 6n |
| 60Degree | L 71 | L 72 | L 73 | L 74 | | L 7m | L 7n |
| 70Degree | L 81 | L 82 | L 83 | L 84 | | L 8m | L 8n |
| 80Degree | L 91 | L 92 | L 93 | L 94 | | L 9m | L 9n |

| Th – Outdoor Air Temperature / Flow Amount L Through Radiator | 60℃ | 50℃ | 40℃ | 30℃ |
|---|---|---|---|---|
| L11 | Tdxx | Tdxx | Tdxx | Tdxx |
| L12 | Tdxx | Tdxx | Tdxx | Tdxx |
| L13 | Tdxx | Tdxx | Tdxx | Tdxx |
| L14 | Tdxx | Tdxx | Tdxx | Tdxx |
| ⋮ | ⋮ | ⋮ | ⋮ | ⋮ |
| L9m | Tdxx | Tdxx | Tdxx | Tdxx |
| L9n | Tdxx | Tdxx | Tdxx | Tdxx |

COOLING CONTROL APPARATUS AND COOLING CONTROL METHOD FOR INTERNAL COMBUSTION ENGINES

BACKGROUND OF THE INVENTION

1. Field of the Invention

The present invention relates to a device for controlling a cooling system of an internal combustion engine and a method for controlling the cooling system of the internal combustion engine in which a circulation passage for a coolant is defined in an internal combustion engine such as an automobile engine or the like and more particularly to a device and a method for controlling a device and a method for controlling the temperature of the coolant to be circulated within the internal combustion engine to remain in an optimum state.

2. Description of the Related Art

In an automobile internal combustion engine (hereinafter referred to as the "engine "), a water cooled type cooling system in which a radiator is provided for cooling the engine is generally used.

In a cooling system of this kind, there is used a thermostat employing a thermal expansion body for controlling the volume of cooling water circulated to the radiator side for controlling the temperature of the cooling water to be introduced into the engine, or a valve unit for controlling the same electrically.

FIG. 13 shows one example of a cooling device using an electrically controlled valve unit.

The numeral 1 denotes an engine composed of a cylinder block 1*a* and a cylinder head 1*b* which define circulation passages therewithin as shown by arrows c.

The numeral 2 denotes a heat exchanger or a radiator which is formed with a known fluid passage 2*c*, radiator 2 being further formed with a cooling water inlet 2*a* and a cooling water outlet 2*b*. Radiator 2 is connected to the engine 1 via a cooling water passage 3 which circulates the cooling water.

The cooling water passage 3 is composed of an outlet side cooling water passage 3*a* communicating the cooling water outlet 1*d* provided in the upper portion of the engine with the cooling water inlet 2*a* provided in the upper portion of said radiator 2, an inlet side cooling water path 3*b* communicating the cooling water outlet 2*b* provided in the lower portion of the radiator with the cooling water inlet 1e provided in the lower portion of the engine 1, and a bypass 3*c* forming an intermediate portions of said cooling water passages 3*a* and 3*b*.

Combination of all of said engine 1, radiator 2 and the cooling water passage 3 completes a circulation passage 4 of the coolant. Then, an electrically controlled valve unit 5 is connected to the inlet side cooling water passage 3*a* between a branch- off portion of the bypass 3*c* and the cooling water inlet 2*a* of the radiator 2.

A butterfly valve or the like is used for said valve unit 5, which is operated to open and close through forward and reverse rotations of an electric motor or the like (not shown) installed in the valve unit such that the volume of the flow of the cooling water to be supplied to the radiator 2 is controlled.

On the other hand, there is provided a temperature detecting element 6 in the form of a thermister or the like at the connection of the inlet side cooling water passage 3*b* and the bypass 3*c*. Values detected by said temperature detecting element 6 are converted by a converter 7 into data recognizable by an engine control unit 8 (hereinafter referred to as ECU) so as to be supplied to said ECU 8 which controls the overall operation of the engine.

From said ECU 8, there are supplied control signals obtained on basis of the values of the temperatures of the cooling water detected by the temperature detecting elements 6 to a motor control circuit 9, which is constructed such that a drive current is supplied to the motor provided in the valve unit 5 from a battery 10 by the control signals from the ECU 8.

Further, FIG. 13 shows a water pump 11 provided at the inlet portion 1e of the engine 1 such that the cooling water is forced to be circulated by the revolution of a crankshaft (not shown) of the engine 1. Further, the numeral 12 denotes a fan unit for forcibly introducing a cooling air to the radiator 2, said fan unit 12 being composed of the cooling fan 12*a* and the motor 12*b* for driving the same.

In a construction described in the foregoing, as soon as the engine is started, water pump 11 is driven to rotate such that the cooling water is forced to be circulated. In this case, because the temperature of the cooling water detected by the temperature detecting element 6 is low immediately after the engine start, a signal for closing the valve unit 5 is issued thereto from said ECU 8, the motor (not shown) for controlling a butterfly valve opening angle causes the valve to be closed controlled to stay at a closed state.

Therefore, almost all of the cooling water from the engine 1 is circulated through the bypass 3*c* to reduce the radiation of the cooling water at the radiator.

Then, when the engine 1 is heated to raise the temperature of the cooling water, a valve open command is issued from the ECU 8 to the valve unit 5 in accordance with the cooling water temperature detected by the temperature detecting element 6 to open the butterfly valve.

Therefore, the cooling water is circulated to the radiator 2 in accordance with the extent of the valve opening where the fan unit 12 performs forced air cooling. The cooling water thus caused to circulate through the radiator 2 mixes with the cooling water which circulate through the bypass 3*c* and flows through the passages c of the engine 1 to cool the same.

In the cooling system, the engine is cooled by the mixture of the cooling water cooled by the radiator and the cooling water which circulates the bypass while the valve unit is operated to open and close in accordance with the information on the temperature from the temperature detecting element in the form of a thermister provided at a portion where the water from the radiator side and the bypass side meet to mix.

Then, the fan motor 12*b* in the fan unit 12 as a means for performing a forced air cooling is also subjected to an intermittent on- and-off control by use of the parameters based on the temperature of the cooling water, the,engine operation or the like to coordinate the temperature control of the engine in a predetermined range.

In this connection, the thus described control of the cooling operation includes a control of the valve opening by ECU after the temperature detecting element detects the temperature variation of the mixture (hereinafter referred to as Tmix) of the cooling water from the radiator side and the cooling water from the bypss side and that of an intermittent forced air cooling by means of the fan unit 12.

Therefore, when the fan unit 12 starts or stops particularly in the case of the idle running of a car, the variation of the radiation effect is so sharp that it is extremely difficult to perform the temperature control of the cooling water.

FIG. 14 shows on e ex ample of this state, in which the temperature of said Tmix rises and lowers sharply with a substantial range of ±α in accordance with the start and stop (in FIG. 14, shown by ON and OFF) of the fan unit 12.

In general, the engine is operated to accomplish fuel economy by driving at a high temperature not to an extent to overheat while the generation of poisonous gases can be suppressed to a certain degree.

However , there remains a technical problem in the case of a substantial hunting as described in the foregoing that it cannot help but to set said Tmix at a substantially low level in order to avoid the worst situation such as the engine reaching the state of overheating, thus resulting in an unfavorable fuel consumption.

SUMMARY OF THE INVENTION

The present invention solves the above described technical problem and particularly provides a device and a method for controlling a cooling system which performs a temperature control in the form of predicting the temperature change of the cooling water by incorporating information on the operation of the cooling fan to prevent a substantial hunting as described in the foregoing.

The present invention made in order to solve the above mentioned problem is constructed such that there is provided a device for controlling a cooling system for the internal combustion engine in which there is provided in a coolant circulation route between flow passages defined in the internal combustion engine and a flow passage defined in a heat exchanger such that heat generated in the internal combustion engine is radiated by the heat exchanger, a flow control means for controlling a coolant flow in said circulation route between said internal combustion engine and said heat exchanger; forced air cooling means provided in association with said heat exchanger for intermittently effecting a forced air cooling work to said heat exchanger; and a control unit to produce command signals for controlling the amount of a coolant flow in said flow control means by receiving first information showing at least one of the operation and the non operation of said forced air cooling means, second information showing a coolant flow amount by means of said flow control means, third information showing a temperature of the coolant flowing out of said internal combustion engine, fourth information showing outdoor air temperature, and fifth information showing the volume of a wind coming into contact with said heat exchanger.

In this case, there is an embodiment in which said control unit is further supplied with sixth information showing the amount of the coolant flowing through said heat exchanger, said flow control means producing a command signal for controlling the amount of the coolant flow together with said first through fifth information. said first information is produced in accordance with the operation or non-operation of a electric motor to drive rotate a fan for taking in cooling air to said heat exchanger.

In a further embodiment, said first information is produced in accordance with the operation or non-operation of an electric motor to drive rotate a fan for taking in cooling air to said heat exchanger while said second information is produced in accordance with an opening angle of a valve provided in a cylindrical coolant passage to vary the amount of the coolant flowing therethrough.

Further, said fifth information is produced in accordance with information on the speed of a vehicle carrying the internal combustion engine while said sixth information is produced in accordance with the number of revolution of the internal combustion engine and the opening angle of a valve of said means for controlling the amount of the flow.

In a further favorable mode of embodiment, said control unit is composed of a first table for obtaining temperature drop data of the coolant the temperature of which lowers by said heat exchanger, and a second table for obtaining the amount of flow of the coolant controlled by said flow control means on the basis of the temperature drop data obtained by the first table.

Further, it is also possible to construct such that said temperature drop data which are lowered by the heat exchanger are obtained from the first table by adding sixth information to said first through fifth information.

Further, a method of controlling the cooling system of the internal combustion engine according to the present invention is characterized in that there is provided in a coolant circulation route between flow passages defined in the internal combustion engine and a flow passage defined in a heat exchanger such that heat generated in the internal combustion engine is radiated by the radiator, said method comprising the steps of loading first information showing at least one of the operation and the non-operation of said forced air cooling means, second information showing a coolant flow amount by means of said flow control means for controlling the coolant flowing through said circulation route between the flow passages defined in the internal combustion engine and a flow passage in a heat exchanger, third information showing a temperature of the coolant flowing out of said internal combustion engine, fourth information showing outdoor air temperature, fifth information showing the volume of a wind coming into contact with said heat exchanger; obtaining coolant temperature drop data which lowers in accordance with respective operational states of the forced air cooling means; obtaining an optimum flow of the coolant controlled by the flow control means in accordance with said temperature drop data; and executing the flow control of the coolant flowing into the heat exchanger in accordance with the optimum flow of said coolant.

Further, in addition to steps of loading first to fifth information, the method further includes a step of loading sixth information showing the amount of the coolant flowing through the heat exchanger.

According to a device and method of controlling the cooling system for the internal combustion engine, the operation or the non-operation of the forced air cooling means in the form of a cooling fan for the heat exchanger in the form of a radiator is determined by loading the first through sixth information or first through sixth information.

Then, the temperature drop of the coolant or the cooling water accomplished by the radiator is calculated in accordance with the operation of the cooling fan. Then, the optimum amount of the flow of the coolant controlled by the butterfly valve as a means of the flow control means, that is to say, the optimum opening data of the butterfly valve are obtained.

Then, a flow control of the cooling water based on the obtained optimum opening data of the valve, that is to say, a valve opening control is accomplished.

In this case, the amount of the coolant temperature drop effected by the radiator can be taken out from the map which is stored with, for example, the measured data. Based on such data, an optimum valve opening angle is determined.

In view of this sharp change in the temperature of the cooling water particularly resulting from the operation of the cooling fan, a prompt measure can be taken to administer the temperature as a result of the valve opening control in response thereto with the result that a substantial hunting in relation to the set temperature can be prevented.

Therefore , it i s possible to operate the engine at a high temperature below that at which the engine overheats, thus accomplishing the fuel economy as well as a substantial reduction in generation of poisonous gases.

BRIEF DESCRIPTION OF THE DRAWINGS

FIG. 10 is a view showing the map utilized in the processing routine shown in FIG. 9;

DETAILED DESCRIPTION OF THE PREFERRED EMBODIMENTS

Figure 1:
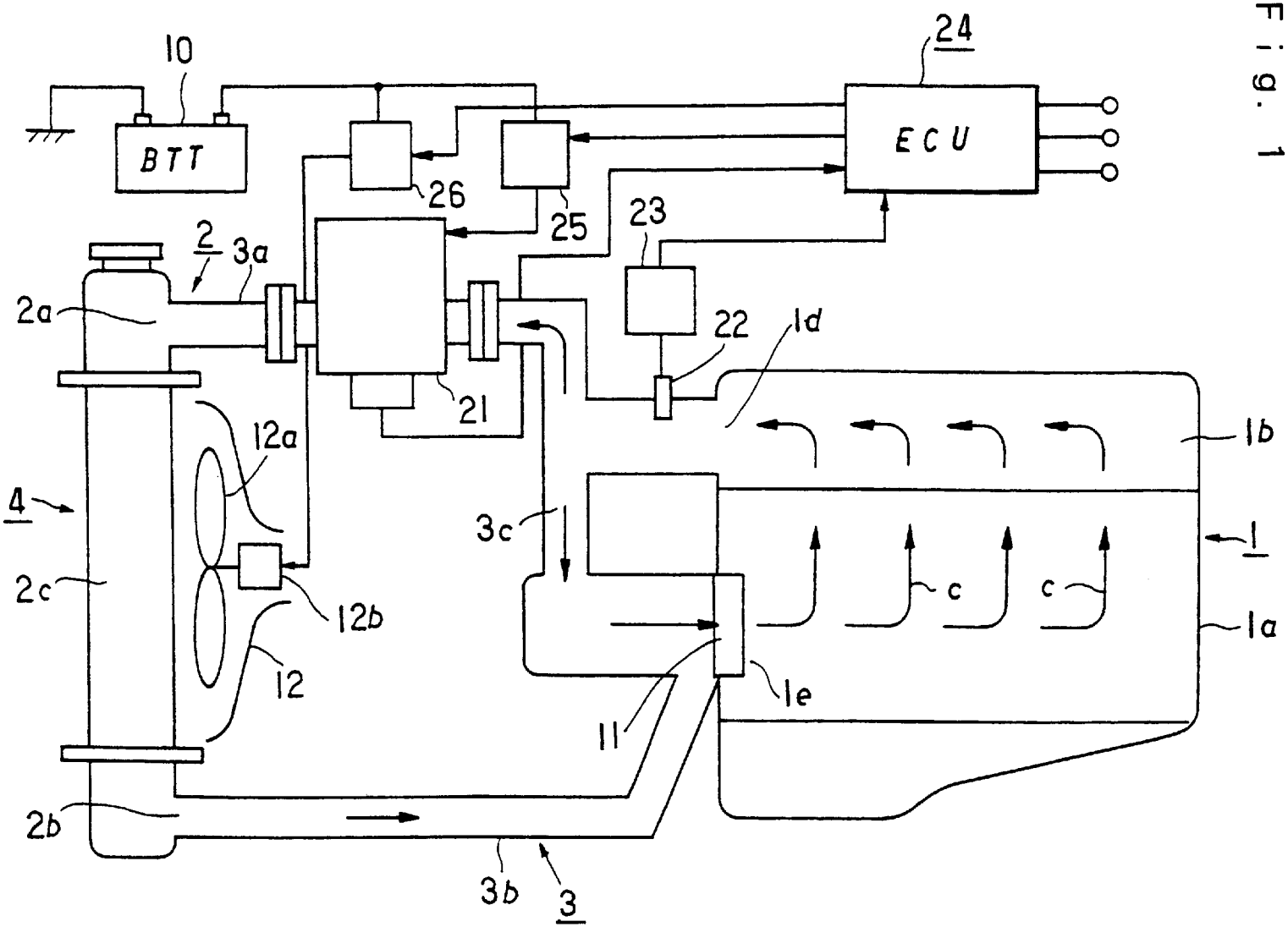
FIG. 1 show an embodiment of the present invention showing the construction of the device for controlling a cooling system incorporated in an automobile engine.

Hereinafter, the device for controlling the cooling system of an internal combustion engine and the method for controlling such cooling system with reference to the embodiments shown in the drawings.

Figure 13:
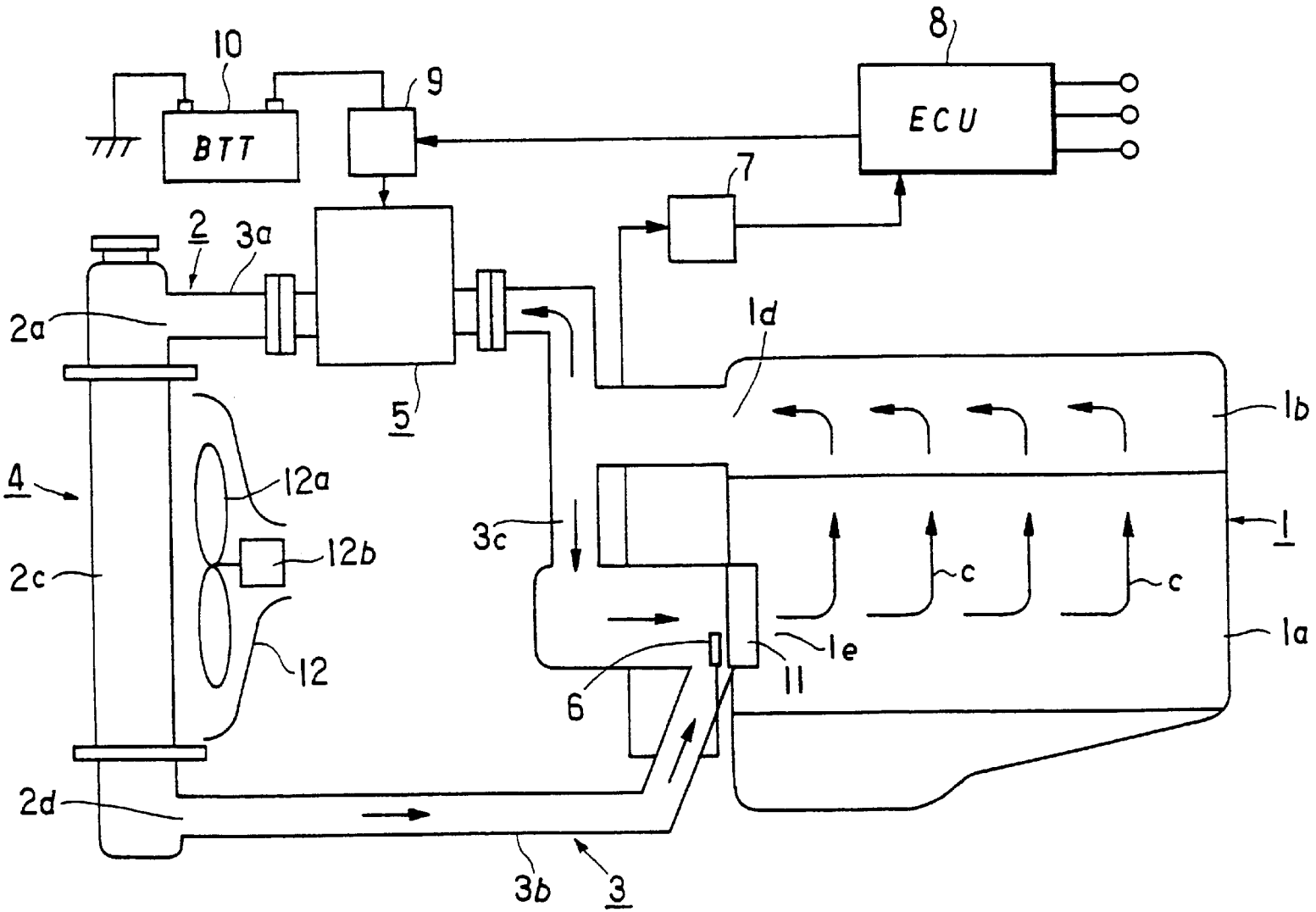
FIG. 13 is a view showing one example of a conventional device for controlling the cooling system.
Figure 14:
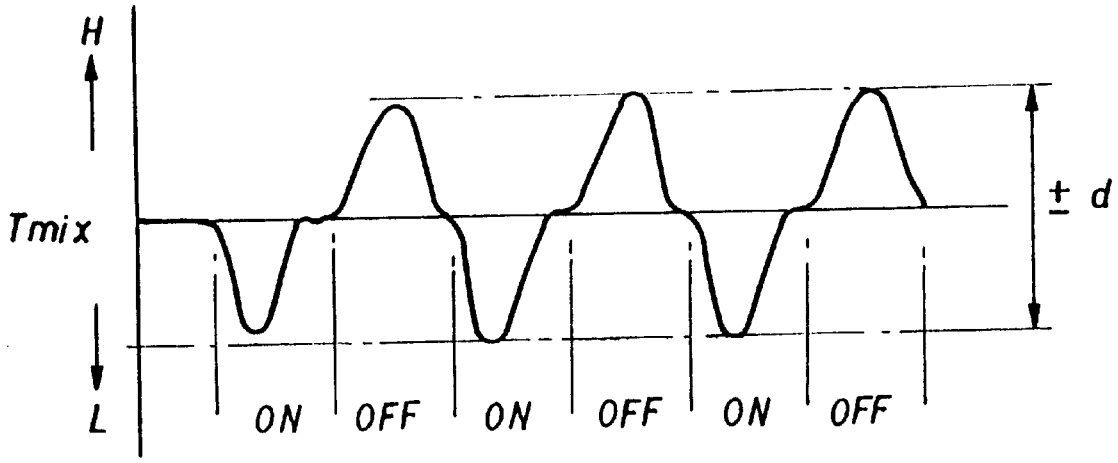
FIG. 14 is a time chart showing a change in the temperature of the cooling water by the device for controlling the cooling system shown in FIG. 13.

FIG. 1 shows the overall structure applied to the device for controlling a cooling system of the internal combustion engine of an automobile engine. In FIG. 1, the numerals and the characters used in portions corresponding to those of the conventional device shown in FIG. 13 denote similar members and explanations of individual structures and the operations are omitted so long as permissible.

As shown in FIG. 1, there is provided an outlet side cooling water passage 3*a* between the outlet portion 1*d* provided for the cooling water used as a coolant at an upper portion of the engine 1 in the form of an internal combustion engine and the inlet portion 2*a* provided for the cooling water at an upper portion of radiator 2 in the form of a heat exchanger. A valve unit 21 is flange connected as a means for controlling the volume of the flow in said outlet side cooling water passage 3*a*.

Further, there is provided a temperature detecting element 22 in the form of a thermister at the cooling water outlet portion 1*d* of said engine 1. Values detected by said temperature detecting element 22, that is to say, the information regarding the water temperature at the outlet of the engine (hereinafter also referred to as the third information) is converted by a converter 23 into data recognizable by the engine control unit 24 (hereinafter referred to as ECU) to be supplied to said ECU which controls the overall operation of the engine.

In the embodiment shown in FIG. 1, a signal (hereinafter referred to as the second information) showing the rotation angle of the butterfly valve obtained by an angular sensor provided in the valve unit 21 as will be described later is supplied to ECU 24.

Although not shown, said engine control unit 24 is constructed such that signals (hereinafter referred to as the first information) to show the operation or non-operation of the fan motor 12*b* in the fan unit 12 for the purpose of forced air cooling, signals to show the outdoor air temperature (hereinafter referred to as the fourth information), the extent of the volume of the air to contact the radiator or the speed of the car (hereinafter referred to as the fifth information), and signals to show the volume of the coolant passing through the heat exchanger or the number of engine revolution (hereinafter referred to as the sixth information) are supplied thereto.

ECU 24 is supplied with the first to fifth or to sixth information to execute operations which will be described later such that command signals to be fed to the valve unit 21 are produced.

The command signals are supplied to a motor control circuit 25, which controls an electric current from the battery 10 and applies a drive current to a direct current motor which is equipped in the valve unit 21 to be described later.

Further, a motor control circuit 26 composed of a relay is structured to be supplied with on and off command signals from ECU 24 such that intermittent drive signals are supplied to the fan motor 12*b* from the battery 10 by way of the motor control circuit 26. Thus, the radiator 2 is subjected to forced air cooling by the on-action of the fan motor 12*b*.

Figure 2:
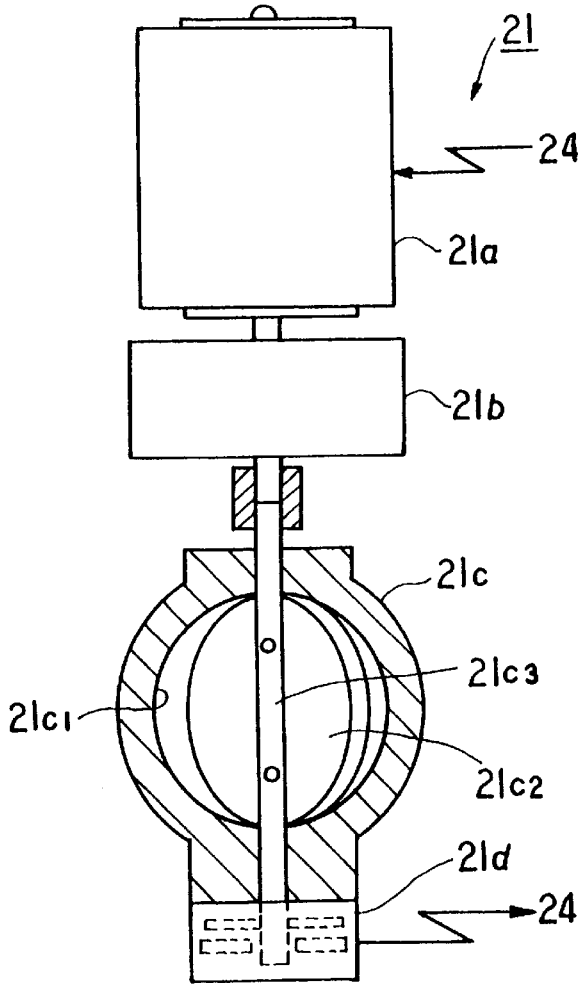
FIG. 2 is partly in section of the construction of the means for controlling the volume of the fluid flow utilized in the device shown in FIG. 1.

FIG. 2 typically shows the structure of the valve unit 21, which is equipped with a direct current motor 21a as mentioned above. The direct current motor 21a receives a drive current from the motor control circuit 25 to be driven to make forward and reverse revolutions. The drive shaft of the motor 21a is connected to the reduction gear 21*b*.

The reduction gear 21*b* is connected to the drive shaft of the butterfly valve 21*c*. The butterfly valve 21*c* is composed of a cylindrical coolant passage 21*c*1 and a planar valve 21*c*2 provided in said passage 21*c*1. The valve 21*c*2 is adapted to control the volume of the cooling water with a plane angle thereof defined by the rotational angle of the support shaft 21*c*3 against the direction of the cooling water flow. That is to say, when the plane angle is at zero degrees against the direction of the cooling water flow, the valve is open while when the angle of the plane is at 90 degrees against the direction of the cooling water flow, the valve is closed.

By properly taking intermediate angles, the volume of the cooling water flow is linearly controlled.

The end of the support shaft 21*c*3 opposite the reduction gear 21*b* is attached with an angle sensor 21*d*, by means of which the rotational angle of the butterfly valve 21*c* (hereinafter referred to as the opening angle) is recognized. Thus, the output of the angle sensor 21*d* is supplied to the ECU 24 as described the above.

Figure 3:
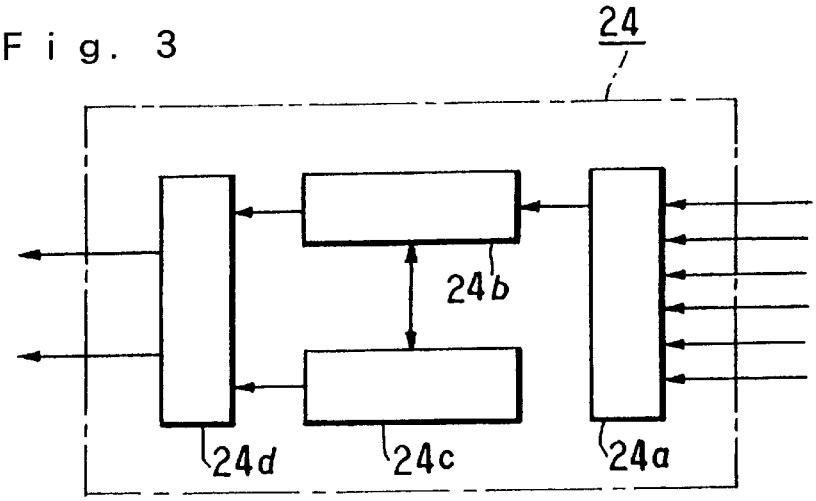
FIG. 3 is a block diagram showing the construction of the control unit (ECU) used in the device shown in FIG. 1.

FIG. 3 shows a basic structure of the ECU 24, which is composed of a signal processing unit 24*a* to receive and convert the first to sixth information or the like into digital signals recognizable by the ECU, a comparing element 24*b* to compare input data processed by the signal processing unit 24*a* and various data stored in the form of a table, as will be described later on in a memory 24*c*, and a signal processing unit 24d to compute and process results obtained by the comparing element and to output command signals to the valve unit 21.

Next, the operation of the device for controlling the cooling system of an automobile engine as shown in FIGS. 1–3 will be explained in accordance with the control flow executed by the ECU 24 shown in FIG. 4 and thereafter.

Figure 4:
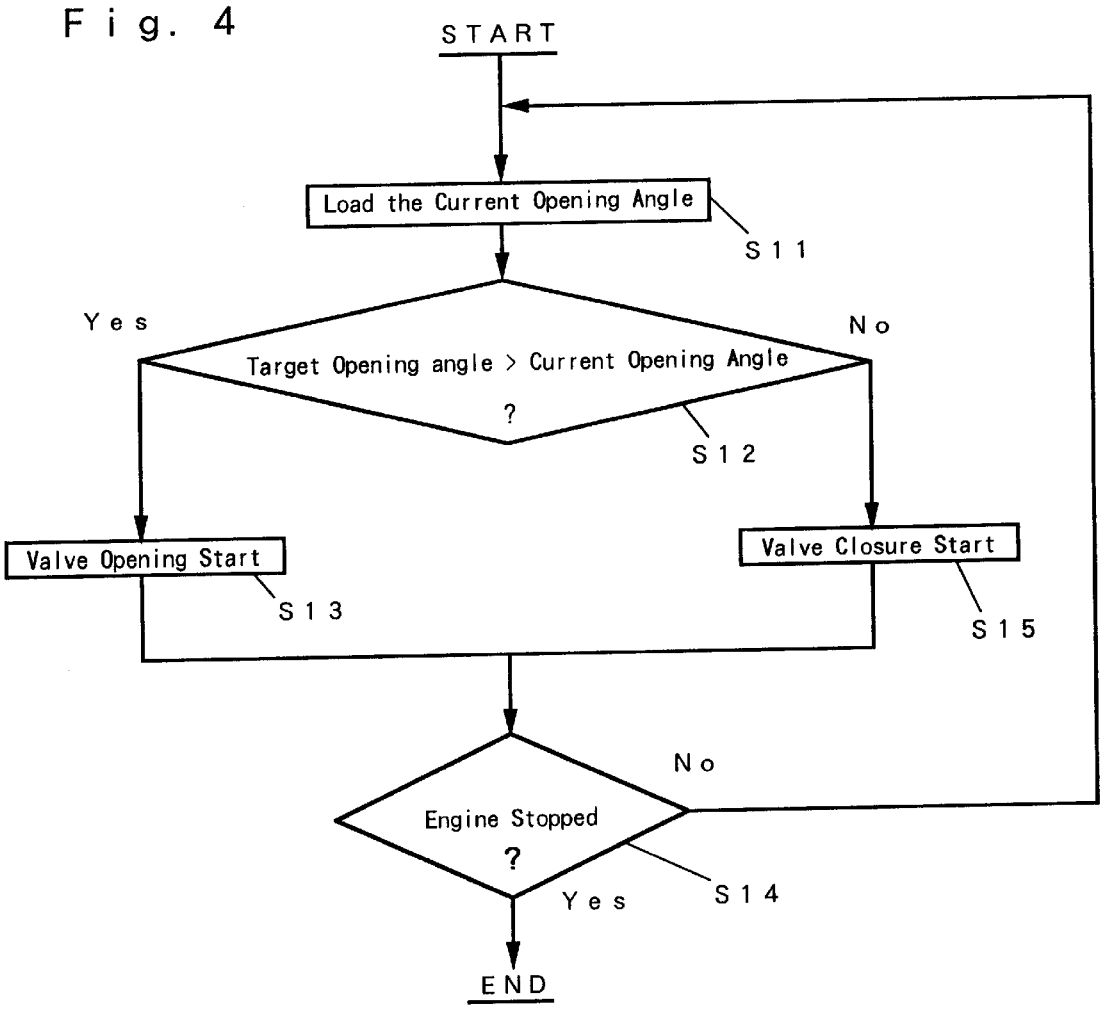
FIG. 4 is a flow chart for explaining the operation of the device shown in FIG. 1.

FIG. 4 shows a main flow to control the opening angle of the butterfly valve. First, when the engine is started, information on a current opening angle of the butterfly valve 21*c* is loaded on the basis of the information from the angle sensor 21*d* in the valve unit 21 at step S11. Then, at step S12, a target opening angle and a current opening angle as will be described later are compared to determine whether or not the target open angle is greater than the current opening angle. If the determination is YES, an open- the- butterfly valve 21*c* command is executed at step S13. This is done by issuing a command signal to the motor control circuit 25 from ECU 24 to apply a drive current to the direct current motor 21*a* in the valve unit 21 for a predetermined period of time such that the valve 21*c* is opened.

Then, a determination is made as to whether or not the engine is stopped at step S14. If the engine is not stopped, the procedure goes back to step S11, where similar routines are repeated. If the target opening angle is not larger than the current opening angle, that is to say, determination is made NO, the procedure goes to step S15, whereby the open-the-butterfly-valve-21*c*-command is executed. This is done by issuing a command signal from ECU 24 to the motor control circuit as in the foregoing to apply a drive current to the direct current motor 21*a* in the valve unit for a predetermined period of time such that the valve is closed.

While the engine is running in this manner, the main routine which always controls the opening angle of the butterfly valve 21*c* is repeated.

Figure 5:
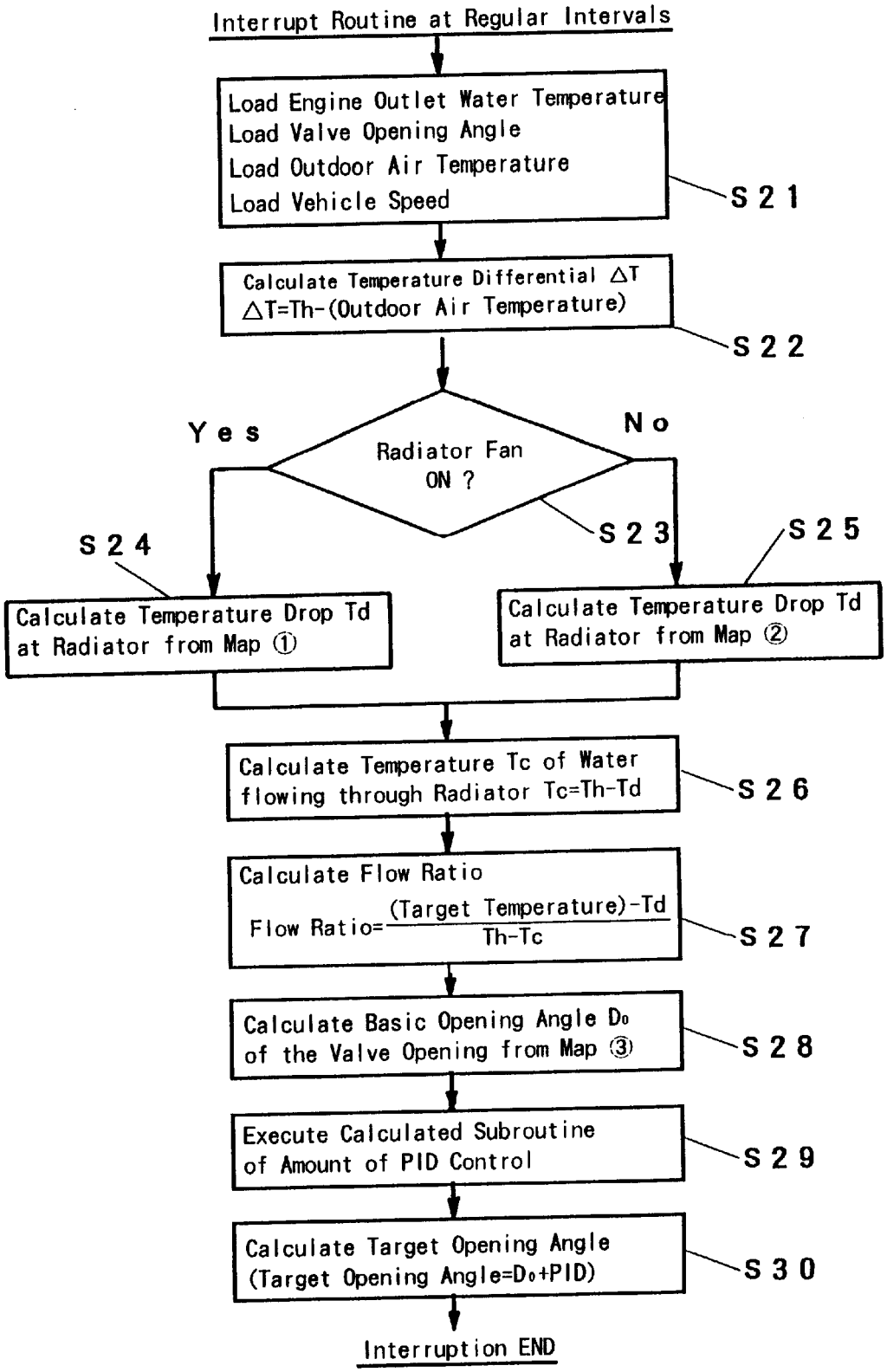
FIG. 5 is a flow chart showing the first embodiment of the interrupt processing routine as against the routine shown in FIG. 4.

FIG. 5 shows the first embodiment of the interrupt processing routine in which an interruption is done at an interval of a predetermined time to interrupt into the main routine. That is to say, a water temperature at the engine outlet (the third information), a valve opening angle (the second information), an outdoor air temperature (the fourth information), and a vehicle speed (the fifth information) are loaded for example at predetermined time intervals at step S21.

The water temperature at the engine outlet is obtained from the temperature detection element 22, the opening angle from the angle sensor 21*d* in the valve unit 21, said outdoor air temperature (not shown) from a temperature sensor and the vehicle speed (not shown) from a speedometer.

Then, a differential Δ T between the water temperature That the engine outlet and the outdoor air temperature is obtained at step S22. Then, the procedure goes to step S23 to determine whether or not the radiator fan is ON. This is for the purpose of determining whether or not the fan 12*a* as a means for forced air cooling is in operation. This can be determined by the presence or absence of the drive command signal for the fan motor 12*b* issued from ECU 24 itself.

Figures 6, 7, 8:
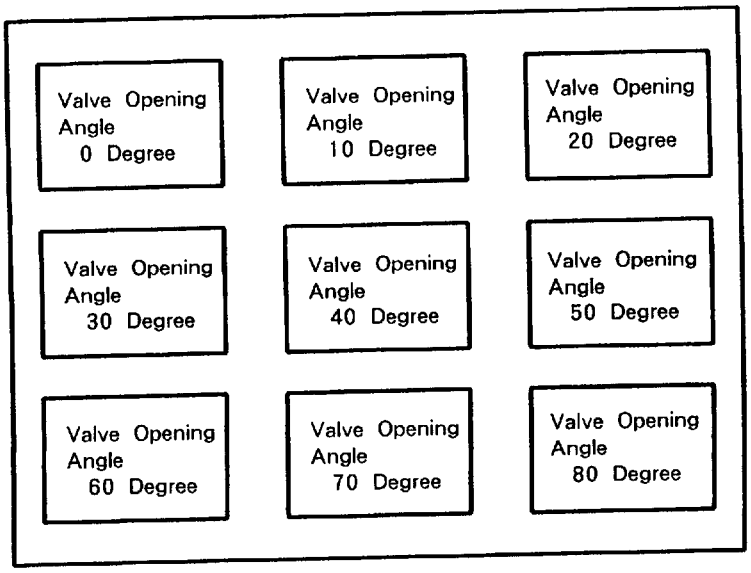
FIG. 6 is a view showing the structure of a map used in the processing routine shown in FIG. 5.
FIG. 7 is a view showing a detailed structure of the map of FIG. 6.
FIG. 8 is a view showing a modification of the map used in the processing routine shown in FIG. 5.

In this state, it is determined that the radiator fan is ON (YES), the procedure goes to step S24, where readout is done from the map ① in the form of tables as shown in FIG. 6 and FIG. 7 for calculation of the temperature drop Td at the radiator.

In other words, a map corresponding to each opening angle is shown in FIG. 6 whereas the temperature drop data Td at the radiator as described in corresponding to the opening angle of the relevant valve is shown in FIG. 7. The temperature drop data Td are arranged in the matrix of the temperature differential Δ T, that is, Th—the outdoor air temperature and the vehicle speed loaded in step S21 in which the temperature drop data Td11~Td94 corresponding thereto are described. Therefore, the temperature drop data Td from such map ① can be obtained.

The map in the form of a table as shown in FIG. 6 and FIG. 7 is quadratically depicted, the map being stored in the memory 24*c* in FIG. 3 as three dimensional data.

Further, the map is shown in FIG. 6 corresponding to the nine (9) kinds of valve opening angles considering the economy of space for explanation. In FIG. 7, temperature drop data corresponding to four (4) kinds of temperature differentials and nine (9) kinds of vehicle speeds are shown. It is possible to obtain the temperature drop data Td corresponding to the intermediate values through intermediate interpolation thereof.

Now back to FIG. 5, if it is determined at step S23 that the radiator fan is not ON (No), the procedure goes to step S25 where the temperature drop Td at the radiator is calculated from a map ①. The map ② is substantially the same as those shown in FIG. 6 and FIG. 7 and the respective values including the temperature drop data Td11 to Td94 shown in FIG. 7 are mapped therein in the form characterized at the time when the radiator fan is ON.

Like the map ①, the map ② is again stored in the memory 24*c* as shown in FIG. 3. Further, data from the map ① and the map ② may be structured into a four dimensional form.

Further at step S26, a temperature Tc (=Th—Td) of the cooling water after passing through the radiator is calculated by means of the temperature drop data Td obtained at step S24 and step S25 and the water temperature Th at the engine outlet obtained at step S21. Then, a flow ratio is calculated at step S27 by means of the temperature Tc obtained at step S26. The flow ratio is calculated by means of the target temperature of the cooling water flowing into the engine, the temperature Tc, and the engine outlet temperature Th. In other words, the flow ratio=([target temperature]—Tc)/(Th—Tc) is calculated.

Then, the procedure further goes to step S28, where the basic opening angle Do of the valve opening angle is calculated by means of the map ③. One example of the map ③ is shown in FIG. 8, such that the basic valve opening angle Do corresponding to the flow ratio obtained in previous step S27 is obtained by means of the map ③ shown in FIG. 8.

If the opening angle of the butterfly valve 21*c* is set so as to reach the basic valve opening angle $D_0$ thus obtained, a temperature of the cooling water flowing into the engine should be theoretically set at the target temperature. Actually, however, a situation in which convergence to the neighborhood of the target temperature failed to be attained due to various disturbing elements.

Then, a calculation subroutine of the PID control volume is executed at step S29. By this calculation of PID control, minute opening angle data in the positive direction to correct the time delay up until the time of the change in the temperature at an engine side inlet of the cooling water due to the change in the valve opening angle are calculated.

Then, the valve open target angle is calculated at step S30. This is done at step 28 by adding, as a correction value, the PID control volume obtained at step 28 to the basic opening angle $D_0$. (Target valve opening angle=$D_0$+PID).

The thus obtained target opening angle is used as a target opening angle at step S12 in the main routine shown in FIG. 4. Therefore, the opening angle of the butterfly valve 21*c* is regulated by the function of the main routine such that the the temperature of the cooling water flowing into the engine is set substantially at the target temperature.

Now in step S29, the subroutine of the PID control volume is executed. In the above discussed subroutine, on the other hand, a target valve open degree is set by adding correction values by fuzzy control to execute a valve opening control in a way closer to the ideal way.

Figure 9:
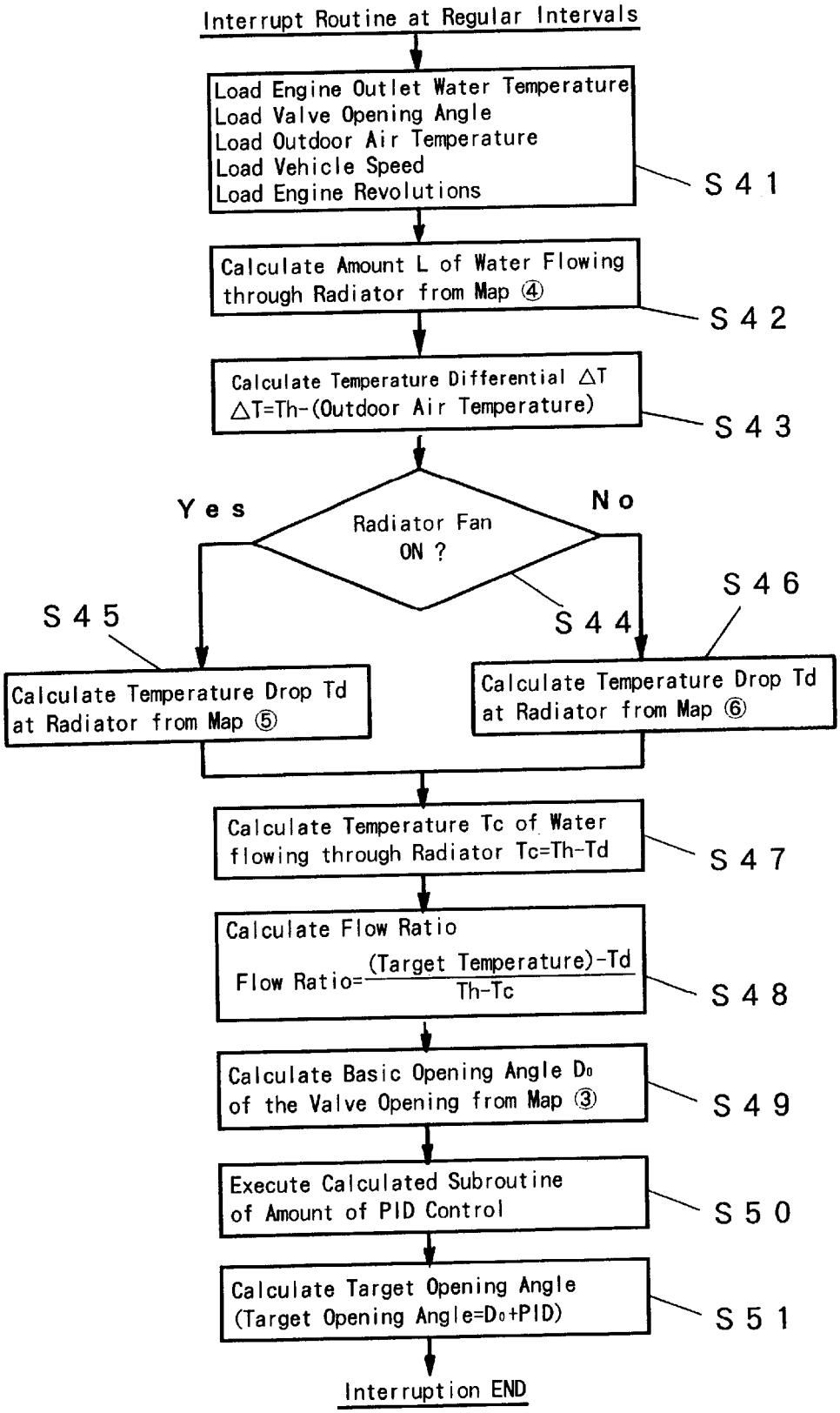
FIG. 9 is a flow chart showing the second embodiment of the interrupt processing routine as against the routine shown in FIG. 4.

Next, FIG. 9 shows a second mode of executing an interrupt processing routine which interrupts into the main routine shown in FIG. 4 at a predetermined interval.

Now, more than half of the interrupt routine shown in FIG. 9 is the same as that shown in FIG. 5. Therefore, the following explanation will be focused on the difference therebetween.

First, the engine outlet water temperature (the third information), the valve opening angle (the second information), the outdoor air temperature (the fourth information), the vehicle speed (the fifth information), and the number of the engine revolutions (the sixth information) are loaded at a predetermined time interval at step S41.

At this step S41, there is a difference from step S21 in loading the number of the engine revolutions is loaded. The information on the number of the engine revolutions is used because a parameter as the power of the engine revolution drives the water pump 11 to thereby change the amount of cooling water supply in accordance with the engine revolution.

Further at step S42, the amount L of cooling water flow through the radiator is obtained from the map ④. One example of the map ④ is shown in FIG. 10, in which the amount L of cooling water flow through the radiator is obtained from combination of the current number of the engine revolution and the current valve opening angle.

Then, the procedure goes to step S43. Steps S43 through S46 are substantially similar to steps S22 through S25 shown in FIG. 5. Therefore, the explanation thereof will be omitted. Provided, however, that for a map ⑤ to be used at step S45, that shown in FIG. 11 and FIG. 12 is used.

Figures 11, 12:
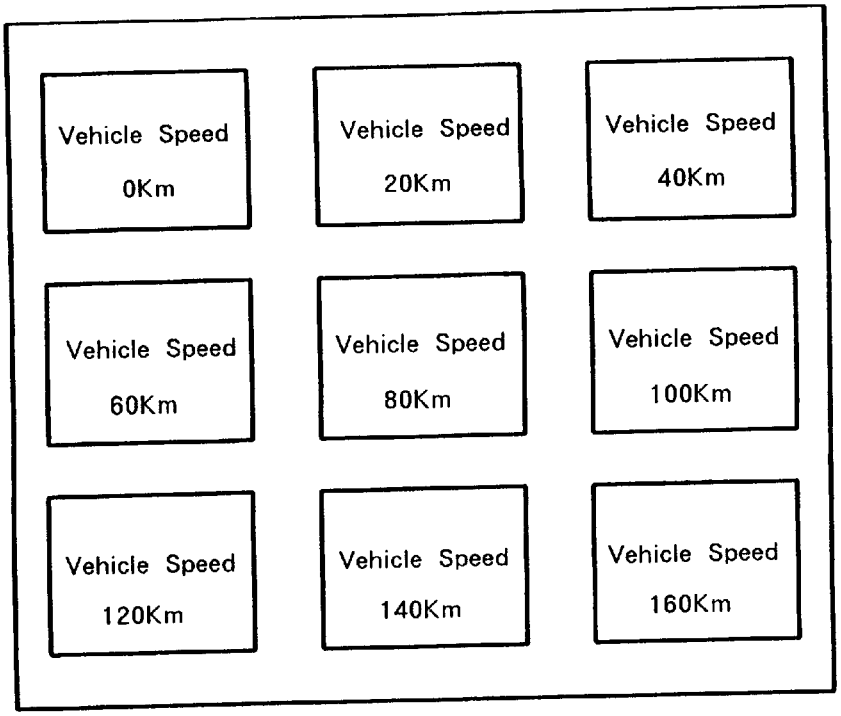
FIG. 11 is a view showing a further modification of the map used in the processing routine shown in FIG. 9.
FIG. 12 is a view showing a detailed structure of the map shown in FIG. 11.

More specifically, FIG. 11 shows the respective maps corresponding to vehicle speeds whereas FIG. 12 shows the temperature drop data Td at the radiator, said temperature drop data Td being described in correspondence to the respective vehicle speeds. The temperature drop data Td is constructed in a matrix composed of the temperature differential Δ, that is to say, Th—the outdoor air temperature and the amount L of cooling water flow L through the radiator obtained at step S42. There are described temperature drop data Tdxx respectively corresponding thereto. Therefore, it is possible to obtain the relevant temperature drop data Td at the radiator from the maps ⑤ as described above.

Further, the map ⑥ used in step S46 is similar to that shown in FIG. 11 and FIG. 12. Provided, however, that only the value of the temperature drop data Tdxx in FIG. 12 is that from the cooling characteristic at the time of the radiator being ON.

In this way, a temperature drop data Tdxx are obtained from the map ⑤ and the map ⑥ to execute the routine shown in steps S47 through S51. Since these steps are similar to steps S26 through S30 shown in FIG. 5, an explanation therefor is omitted. Likewise, the target opening angle obtained at the interrupt processing routine shown in FIG. 9 is used as a target opening angle at step S12 in the main routine shown in FIG. 4.

Although an explanation has so far been provide regarding an embodiment of the invention such as a device for controlling the cooling system for an automobile engine, an application of the invention is not limited to such a specific area but is extendible to other types of internal combustion engines with similar functions and effects.

In the embodiments describe above, a butterfly valve is used as a flow control means but it is also possible to use a puppet valve and digitize the amount of the lift thereof for control of the amount of the cooling water flow with similar functions and effects in the structure.

Further, the respective maps constructed in the form of tables as mentioned above are not limited to those shown in the figures but can take various modifications within a range not deviating from the spirit of the present invention.

What is claimed is:

1. A device for controlling a cooling device for an internal combustion engine including a coolant circulation route between flow passages defined in the internal combustion engine and a flow passage defined in a heat exchanger such that heat generated in the internal combustion engine is radiated by the heat exchanger, the device comprising:

a flow control means for controlling a coolant flow in said circulation route between said internal combustion engine and said heat exchanger;

forced air cooling means provided in association with said heat exchanger for intermittently effecting forced air cooling to the heat exchanger; and a control unit to produce command signals for controlling the amount of a coolant flow in said flow control means by receiving a first information showing at least one of the operation and the non operation of the forced air cooling means, a second information showing a coolant flow amount by means of the flow control means, a third information showing a temperature of the coolant flowing out of the internal combustion engine, a fourth information showing outdoor air temperature, and a fifth information showing the volume of air coming into contact with said heat exchanger.

2. A device for controlling a cooling system for the internal combustion engine according to claim 1, wherein said control unit is further supplied with a sixth information showing the amount of the coolant flowing through said heat exchanger, said flow control means producing a command signal for controlling the amount of the coolant flow together with said first through fifth information.

3. A device for controlling a cooling system for the internal combustion engine according to claim 2, wherein said sixth information is produced in accordance with the number of revolutions of the internal combustion engine and the opening angle of a valve of the means for controlling the amount of the flow.

4. A device for controlling a cooling system for the internal combustion engine according to claim 2, where said control unit comprises:

a first table for obtaining the temperature drop data of the coolant, the temperature of which lowers in accordance with said first through sixth information; and a second table for obtaining the amount of the flow of the coolant controlled by the flow control means in accordance with the temperature drop data obtained by the first table.

5. A device for controlling a cooling system for the internal combustion engine according to either claim 1 or claim 2, wherein said first information is produced in accordance with the operation or non-operation of an electric motor to rotationally drive a fan for taking in cooling air to the heat exchanger.

6. A device for controlling a cooling system for the internal combustion engine according to either claim 1 or claim 2, wherein said second information is produced in accordance with an opening angle of a valve provided in a cylindrical coolant passage to vary the amount of the coolant flowing therethrough.

7. A device for controlling a cooling system for the internal combustion engine according to either claim 1 or claim 2, wherein said fifth information is produced in accordance with information regarding the speed of a vehicle carrying the internal combustion engine.

8. A device for controlling a cooling system for the internal combustion engine according to claim 1, wherein said control unit comprises:

a first table for obtaining temperature drop data of the coolant the temperature of which lowers by the heat exchanger; and a second table for obtaining the amount of flow of the coolant controlled by the flow control means on the basis of the temperature drop data obtained by the first table.

9. A method of controlling a cooling system for an internal combustion engine in which there is provided a coolant circulation route between flow passages defined in the internal combustion engine and a flow passage defined a heat exchanger such that heat generated in the internal combustion engine is radiated by the radiator, said method comprising steps of:

loading a first information showing at least one of the operation and the non-operation of said forced air cooling means, a second information showing a coolant flow amount by means of said flow control means for controlling the coolant flowing through said circulation route between the flow passages defined in the internal combustion engine and a flow passage in a heat exchanger, a third information showing a temperature of the coolant flowing out of the internal combustion engine, a fourth information showing outdoor air temperature, and a fifth information showing the volume of air coming into contact with said heat exchanger;

obtaining coolant temperature drop data which lowers in accordance with respective operational states of the forced air cooling means;

obtaining an optimum flow of the coolant controlled by the flow control means in accordance with said temperature drop data; and executing the flow control of the coolant flowing into the heat exchanger in accordance with the optimum flow of the coolant.

10. A method of controlling a cooling system for the internal combustion engine according to claim 9, further including the step of loading a sixth information showing the amount of the coolant flowing through said heat exchanger.

* * * * *